US005782651A

United States Patent [19]

Konoya

[11] Patent Number: 5,782,651

[45] Date of Patent: *Jul. 21, 1998

[54] ELECTRICAL CONNECTION BOX

[75] Inventor: Hisashi Konoya, Yokkaichi, Japan

[73] Assignee: Sumitomo Wiring Systems, Ltd., Japan

[ * ] Notice: The portion of the term of this patent subsequent to Aug. 30, 2015, has been disclaimed.

[21] Appl. No.: 911,276

[22] Filed: Aug. 14, 1997

Related U.S. Application Data

[63] Continuation of Ser. No. 577,414, Dec. 22, 1995, abandoned.

[30] Foreign Application Priority Data

Dec. 22, 1994 [JP] Japan ..... 6-320023

[51] Int. Cl.[6] ..... H01R 4/24

[52] U.S. Cl. ..... 439/405; 439/76.2; 439/949

[58] Field of Search ..... 439/404, 405, 439/76.2, 949, 45, 47, 403, 396, 79, 714

[56] References Cited

U.S. PATENT DOCUMENTS

| | | | |
|---|---|---|---|
| 4,143,935 | 3/1979 | Goodman et al. | 439/405 |
| 4,897,042 | 1/1990 | Saka et al. | 439/404 |
| 4,938,719 | 7/1990 | Sawai et al. | 439/714 |
| 4,942,617 | 7/1990 | Boylan | 439/17 |
| 4,944,684 | 7/1990 | Leibowitz | 439/76.2 |
| 5,011,417 | 4/1991 | Matsumoto et al. | 439/76.2 |
| 5,057,026 | 10/1991 | Sawai et al. | 439/76.2 |
| 5,067,905 | 11/1991 | Matsumoto et al. | 439/76.2 |
| 5,618,186 | 4/1997 | Saka et al. | 439/76.2 |

FOREIGN PATENT DOCUMENTS 3120627 12/1991 Japan .

*Primary Examiner*—Gary F. Paumen
*Assistant Examiner*—Tho D. Ta
*Attorney, Agent, or Firm*—Jordan B. Bierman; Bierman, Muserlian and Lucas

[57] ABSTRACT

To provide a small electrical connection box in which wires can be arranged with an improved degree of flexibility and which can cope with complicated wiring, the wires are arranged at two vertical planes in the space defined by the upper casing and the lower casing and are electrically connected to cramping terminals which are secured in the casings.

12 Claims, 5 Drawing Sheets

ELECTRICAL CONNECTION BOX

This application is a continuation of application No. 08/577,414, filed Dec. 22, 1995, now abandoned.

This Application claims the benefit of priority of Japanese Application 6-320025, filed Dec. 22, 1994.

The present Invention relates to an electrical connection box used, for example, in wiring an automotive vehicle.

BACKGROUND OF THE INVENTION

As shown in FIG. 6, a known electrical connection box for connecting wires extending from various pieces of equipment is comprised of upper casing 1, lower casing 2, and insulating plate 3 mounted between casings 1 and 2 (see, for example, Japanese Unexamined Utility Model Publication No. 3-120627).

In this connection box, upper casing 1 and lower casing 2 are provided with connector receptacles 4 (those on the lower casing 2 are not shown) and terminal holes 5 in communication with the interior of connector receptacles 4. Cramping terminals 6 are pressed into corresponding terminal holes 5. Each wire W is electrically connected to contact portion 6*a* at one end of each cramping terminal 6, and input/output terminal portion 6*b* at the other end projects into corresponding connector receptacle 4 of lower casing 2 through terminal hole 5. Additionally, the input/output terminal portion 6*b* may project into corresponding connector receptacle 4 of upper casing 1 by way of through hole 3*a* in insulating plate 3 and terminal hole 5.

However, in the prior art electrical connection box, wires W are arranged in parallel, one adjacent the other, between insulating plate 3 and lower casing 2. Accordingly, this electrical connection box can have only limited wire arrangement patterns and cannot cope with complicated wiring.

SUMMARY OF THE INVENTION

In view of the above problem, an object of the Invention is to provide an electrical connection box in which wires can be arranged with a great degree of freedom, in particular for coping with complicated wiring without enlarging the size thereof. According to the Invention, there is provided an electrical connection box comprising a main body having one or more connector receptacles, a first wire group including wires arranged on a first wire plane inside the main body, a second wire group including wires arranged on a second wire plane inside the main body, and wherein cramping terminals are electrically connected to corresponding wires of the first wire group and/or corresponding wires of the second wire group and project into the corresponding connector receptacle.

According to a preferred embodiment of the Invention, the wire planes are spaced apart from each other and, in a particularly preferred form of the Invention, they are parallel to one another. Advantageously, the cramping terminals project into the connector receptacle through corresponding terminal holes formed in the main body and are mounted in corresponding cramping terminal mount portions.

In another desirable form of the device, there is a first terminal group which includes the cramping terminals electrically connected to the corresponding wires of the first wire group and projecting into a first connector receptacle. In addition, there may also be a second terminal group which includes cramping terminals electrically connected to the corresponding wires of the first wire group and projecting into a second connector receptacle. There may also be third and fourth terminal groups, each electrically connected to the corresponding wires of the second wire group, the former projecting into the second connector receptacle and the latter projecting into the first connector receptacle. It is also advantageous to provide projecting portions on the cramping terminals which are of unequal lengths.

According to a further preferred embodiment of the Invention, the main body comprises an upper casing and a lower casing, at least one of the casings being provided with at least one connector receptacle. It is particularly useful to have one connector receptacle on the upper casing and another on the lower casing.

In a particularly advantageous embodiment of the Invention, there are at least two wire groups, at least one of which is located in a plane spaced apart from the other(s). In this embodiment, the cramping terminals of the terminal group are electrically connected to corresponding wires in the two wiring groups which are spaced apart from each other.

One or more insulating plates may be provided between the two adjacent wire planes, wherein parts of the cramping terminals project through corresponding through holes in the insulating plate. For additional strength, the main body comprises at least one wall for supporting the electrical connection box from the inside. Accordingly, upon assembling the upper and the lower casings, the support wall projecting from one of the casings comes into contact with the opposing inner surface of the other casing. Therefore, the rigidity of the casing can be enhanced. One casing is supported from inside by the support wall formed in the other casing. Accordingly, the strength of the casing can be reinforced and the assembled electrical connection box has sufficient rigidity even without the insulating plate.

The most desirable form of the Invention comprises:

upper and lower casings, each provided with a connector receptacle on its outer surface, terminal holes in the connector receptacle and cramping terminal mounts on the inner surfaces of the casings. An insulating plate is in the space between the upper and lower casings and has holes through which input/output terminal portions of the cramping terminals are inserted. There is a first wire group including wires arranged between the upper casing and the insulating plate, and a second wire group including wires arranged between the lower casing and the insulating plate.

A first terminal group, including cramping terminals, is mounted on the connector, each of which has, at one end, an input/output terminal portion which projects into the connector receptacle through the corresponding terminal hole in the upper casing and has, at the other end, a contact portion which is electrically connected to a corresponding wire of the first wire group and mounted on the corresponding cramping terminal mount.

A second terminal group, also mounted on the connector, includes cramping terminals, each having, at one end, a contact portion which is electrically connected to the corresponding wire of the first wire group and having, at the other end, an input/output terminal portion which projects into the connector receptacle through the corresponding through hole in the insulating plate and the corresponding terminal hole in the lower casing.

There is further provided a third terminal group, including cramping terminals, each having, at one end, an input/output terminal portion which projects from the corresponding terminal hole of the lower casing and having, at the other end, a contact portion which is electrically connected to the corresponding wire of the second wire group and is mounted in the corresponding cramping terminal mount.

There is also a fourth terminal group, including cramping terminals, each having, at one end, a contact portion which is electrically connected to the corresponding wire of the second wire group and having, at the other end, an input/output terminal portion which projects from the corresponding terminal hole of the connector receptacle on the upper casing through the corresponding through hole of the insulating plate.

The input/output terminal portions of the cramping terminals connected to the wires of the first and second wire groups are arranged in two vertical stages in the space between the upper and the lower casings and project into connector receptacles on the outer surfaces thereof.

Accordingly, the wires of the first and the second wire groups arranged along the upper and the lower casings on the opposite vertical sides of the insulating plate, are electrically connected to the respective cramping terminals secured on the upper and lower casings. The input/output terminal portions of the respective cramping terminals project from the terminal holes of the connector receptacle of the upper or lower casing to be electrically connected with an external electrical device.

As is clear from the above description, the wires of the first and the second wire groups are arranged along the upper casing and the lower casing, respectively, preferably with the insulating plate therebetween. Accordingly, the wires can be arranged more easily, whereby complicated wiring can be assembled in a compact manner and the dimensions of the electrical connection box itself can be kept to a minimum.

In another embodiment of the Invention, the first and third terminal groups are provided with short input/output terminal portions and the second and fourth terminal groups are provided with long input/output terminal portions. The absence of the insulating plate from this form of the Invention reduces the number of parts and makes the connector easier to assemble.

BRIEF DESCRIPTION OF THE DRAWINGS

In the accompanying drawings, constituting a part hereof, and in which like reference characters indicate like parts.

As shown in FIGS. 1, 2, and 3, an electrical connection box according to a first embodiment is comprised of upper casing 11, lower casing 12, and insulating plate 13 in the space defined by upper casing 11 and lower casing 12. Upper casing 11 has a box-like shape which is open at its bottom. Two connector receptacles 14 project from its upper surface. Connector receptacles 14 are rectangular cylinders, and terminal holes 15 are in the floor of connector receptacles 14 (which is also the ceiling of upper casing 11). Cramping terminal mounts 16 project downwardly from the ceiling of upper casing 11 in positions corresponding to cramping terminals 20 in first group A and second group B.

Figure 1:
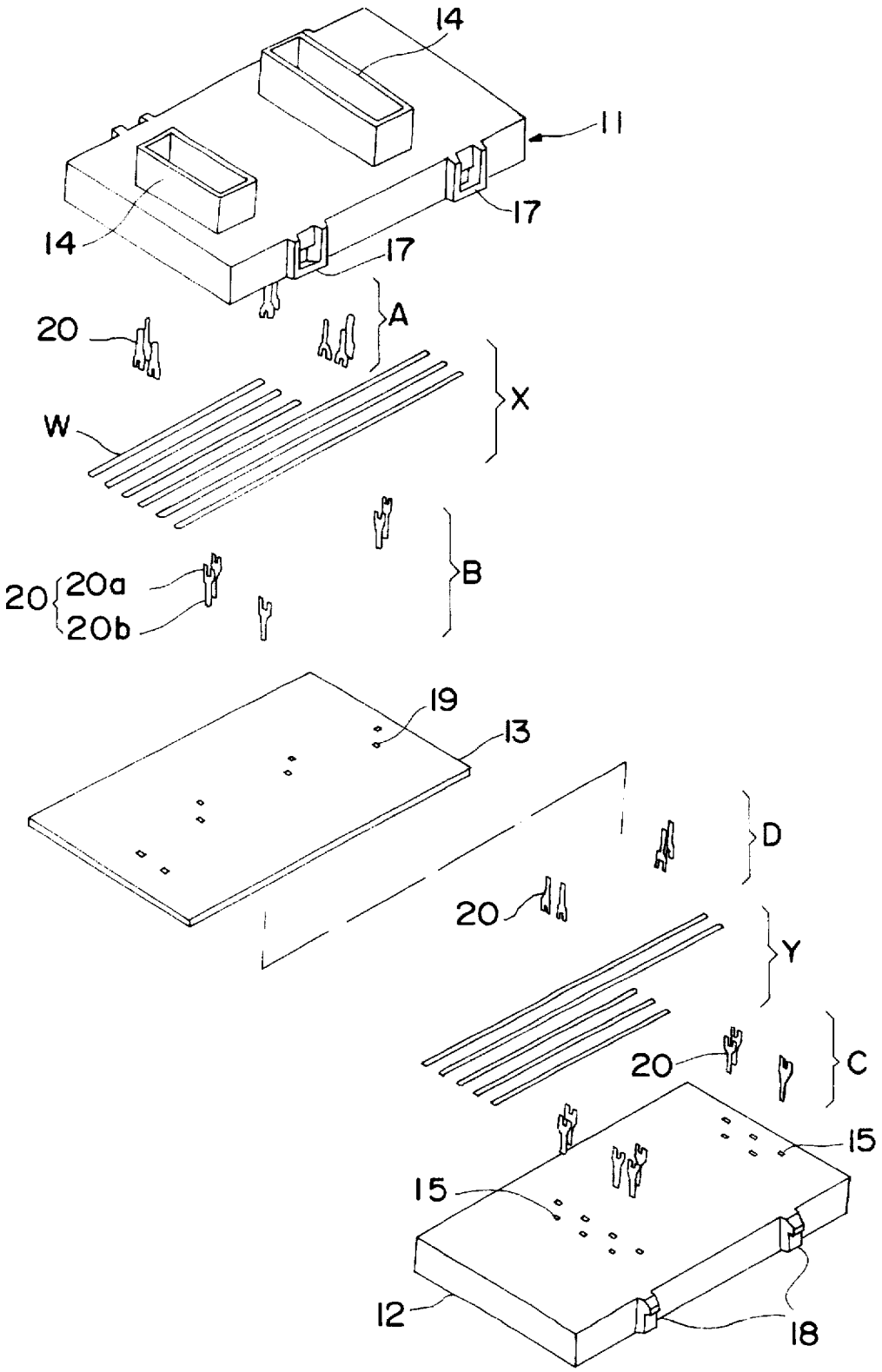
FIG. 1 is an exploded perspective view of the first embodiment of the connection box of the present Invention.
Figure 2:
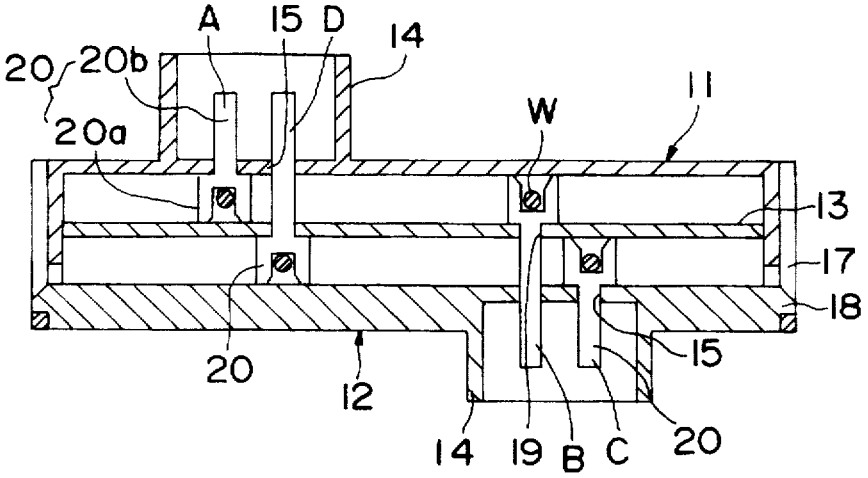
FIG. 2 is a sectional side view of the connector of FIG. 1.
Figure 3:
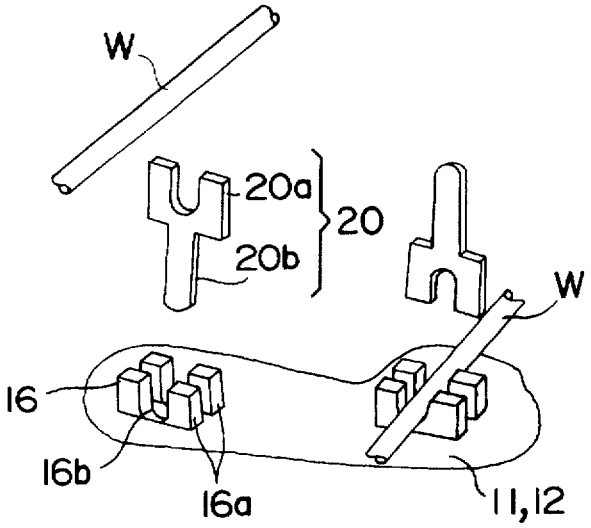
FIG. 3 is an enlarged fragmentary perspective view showing the cramping terminal mounts of FIG. 1.

Each mount 16 is, as shown in FIG. 3, formed by two plate members 16*a* which are parallel to and spaced a specified distance apart from each other. The distance is such that contact portion 20*a* of cramping terminal 20 can be pressed and fixed therebetween. Plate members 16*a* carry slot 16*b* wherein wire W is to be inserted. Further, U-shaped engaging portions 17 are at two points on opposite sides of opposite side surfaces of upper casing 11.

Lower casing 12 is a plate-like member, and connector receptacles 14, similar to those formed on upper casing 11, project from the lower surface thereof. A plurality of terminal holes 15 is formed in lower casing 12, and cramping terminal mounts 16, similar to those on upper casing 11, project from the upper surface of lower casing 12 in positions corresponding to the location of respective cramping terminals 20 in third group C. These terminals are inserted in positions corresponding to respective cramping terminals 20 in fourth group D. Locking portions 18 project from opposite side surfaces of the lower casing 12 at locations corresponding to engaging portions 17.

Insulating plate 13 is of such dimensions that it can be closely accommodated in the interior of upper casing 11. Insulating plate 13 is formed with a plurality of through holes 19 extending from the upper surface to the lower surface thereof.

Cramping terminals 20 are inserted into terminal holes 15; each cramping terminal 20 is of conductive material and has a substantially U-shaped contact portion 20*a* at one end thereof and an input/output terminal portion 20*b* at its other end. As wires W are pressed into the slots of contact portions 20*a*, the edges of the slots penetrate the insulating sheaths, thereby establishing an electrical connection between cramping terminals 20 and the cores of wires W. Contact portions 20*a* are pressed and fixed in the respective mounts 16 of upper and lower casings 11 and 12. Input/output terminal portions 20*b* are inserted into terminal holes 15 directly or through through holes 19 of insulating plate 13 to project into connector receptacles 14 thereof.

To assemble the electrical connection box, input/output terminal portions 20*b* of cramping terminals 20 of first terminal group A are inserted into terminal holes 15 of upper casing 11 and project into connector receptacles 14. The plurality of wires W (first wire group X) is placed in slot 16*b* of terminal mounts 16, and contact portions 20*a* of terminals 20 are pressed between mounts 16, whereby wires W and cramping terminals 20 are fixed. Further, the appropriate arranged wires W of first wire group X are pressed into the slots of contact portions 20*a* of cramping terminals 20 of second terminal group B; input/output portions 20*b* are then pressed and secured between plate members 16*a* of mounts 16 of lower casing 12. Similarly, cramping terminals 20 of third terminal group C are inserted into terminal holes 15 of lower casing 12, a plurality of wires W (second wire group Y) is pressed into the slot between contact portions 20*a*, and pressed and secured between mounts 16. Further, the appropriate wires W are electrically connected with contact portions 20*a* of cramping terminals 20 of fourth terminal group D, and pressed and secured in mounts 16 of lower casing 12.

Subsequently, upper and lower casings 11 and 12 are assembled so that insulating plate 13 is located therebetween. At this stage, input/output terminal portions 20*b* of cramping terminals 20 of group B secured in upper casing 11 project into corresponding connector receptacles 14 on lower casing 12 by way of through holes 19 of insulating plate 13 and terminal holes 15 of lower casing 12. Moreover, group D input/output terminal portions 20*b* secured in lower casing 12 project into the corresponding connector receptacles 14 on upper casing 11 by way of through holes 19 in insulating plate 13 and terminal holes 15 of upper casing 11. Upper and the lower casings 11 and 12 are assembled by engagement of locking portion 18 with engaging portion 17.

In the electrical connection box thus assembled, since wires W can be arranged along upper casing 11 and lower casing 12 with insulating plate 13 therebetween, the wire arrangement in casings 11 and 12 can be simplified. Further, this electrical connection box can readily cope with complicated wiring without enlarging the size thereof.

Figure 4:
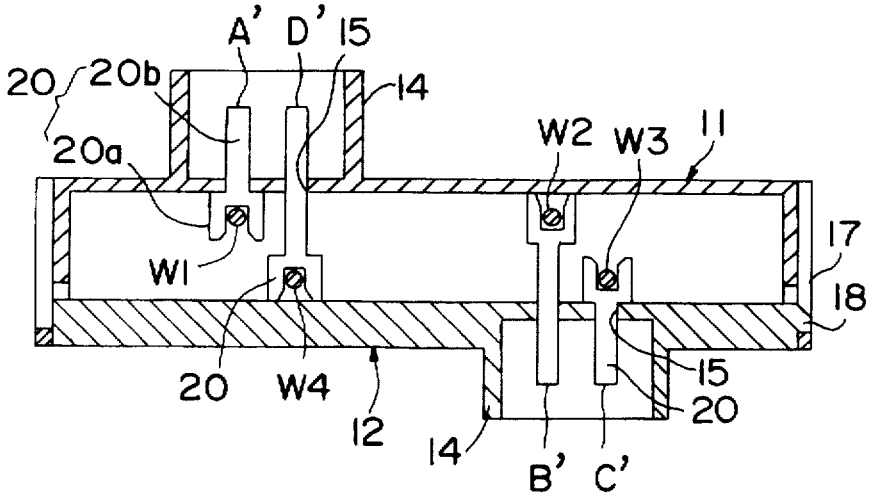
FIG. 4 is a view, like that of FIG. 2, of a second embodiment of the present Invention.

FIG. 4 shows an electrical connection box which does not need the insulating plate 13 of the first embodiment. As in the first embodiment, upper casing 11 is provided with connector receptacle 14, terminal holes 15, cramping terminal mounts 16 (see FIG. 3) and engaging portion 17 which locks upper casing 11 to lower casing 12. Correspondingly, lower casing 12 has connector receptacle 14, terminal holes 15, cramping terminal mounts 16, and locking portion 18 engageable with engaging portion 17 of upper casing 11.

Cramping terminals 20 of first terminal group A', having shorter input/output terminal portions **20*b*, and cramping terminals 20 of fourth terminal group D', having longer input/output portions 20*b*, are inserted into terminal holes 15 of upper casing 11. In the same manner, cramping terminals 20 of third terminal group C', having shorter input/output terminal portions 20*b*, and cramping terminals 20 of second terminal group B', having longer input/output portions 20*b*, are inserted into terminal holes 15 of lower casing 12**.

Wires W1 and W2 of first wire group X, which are arranged along upper casing 11, are connected to cramping terminals 20 of first and second terminal groups A' and B'. Further, wires W3 and W4 of second wire group Y, which are arranged along lower casing 12, are connected to cramping terminals 20 of third and fourth terminal groups C' and D'. In the assembled electrical connection box, wires W1 and W2 of the first wire group are on a first plane and wires W3 and W4 of the second wire group are on a second plane. Further, the first and the second planes are spaced apart vertically.

Figure 5:
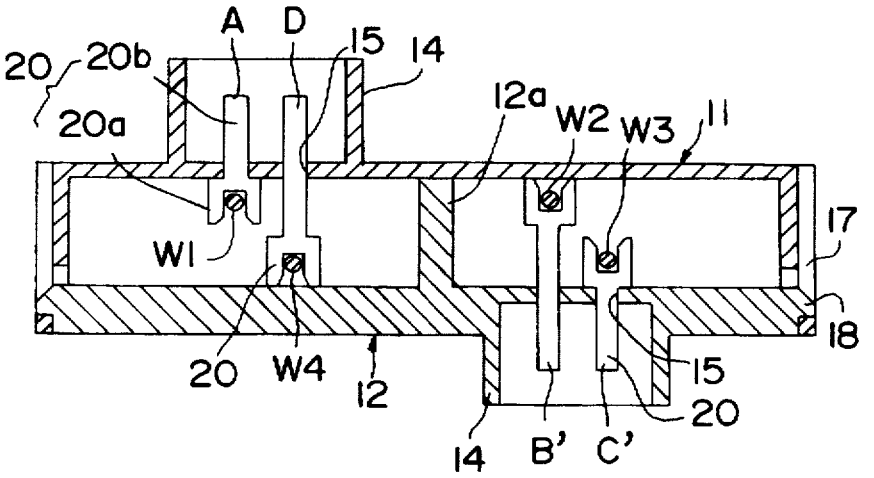
FIG. 5 is a view, like that of FIG. 4, of a modification of the second embodiment.
Figure 6:
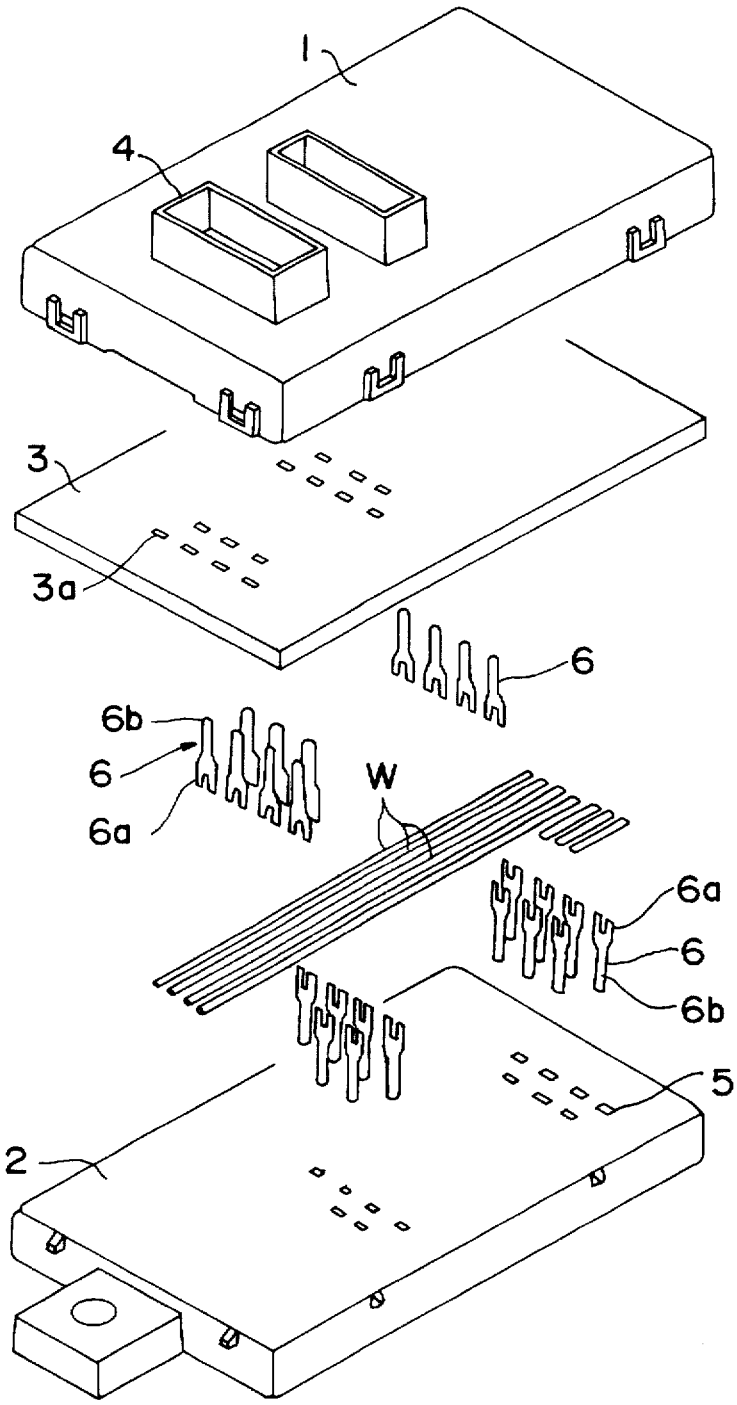
FIG. 6 PRIOR ART
FIG. 6 is an exploded perspective view of a prior art electrical connection box.

The above electrical connection box is assembled in a similar manner as that of the first embodiment. However, since insulating plate 13 is not required, the number of parts is reduced and assembly made easier. In FIG. 5, wall **12*a* projects from lower casing 12 and supports the upper wall of upper casing 11, whereby the strength of the upper casing 11 is reinforced by the support wall 12*a***.

Figure 7:
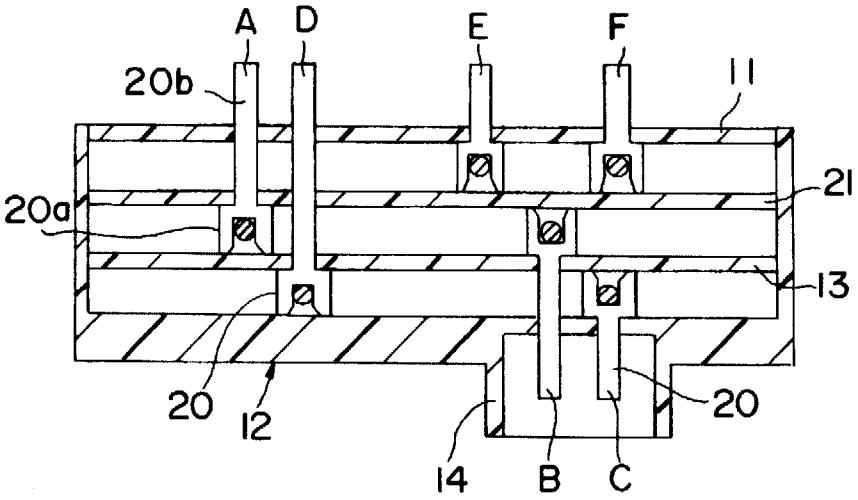
FIG. 7 is a view, similar to that of FIG. 2, showing a further embodiment of the Invention.

Referring to FIG. 7, a further modification of the present Invention is shown. Most of the elements are the same as previously described with respect to other Figures; the difference being the provision of insulating layer 21 and terminal groups E and F. In this embodiment, there is a third layer of wire groups included in the device.

While only a limited number of specific embodiments of the present Invention have been expressly disclosed, it is, nonetheless, to be broadly construed and not to be limited except by the character of the claims appended hereto.

What we claim is:

1. An electrical connection box comprising a main body provided with a connector receptacle, a first wire group on a first plane within said body, a second wire group on a second wire plane within said body, a first terminal group comprising a plurality of cramping terminals, said cramping terminals being electrically connected to corresponding wires of said first wire group and said second wire group, said cramping terminals projecting into said connector receptacle, said cramping terminals being mounted on terminal mounts on an interior surface of said main body, and extending both above and below said surface, said receptacle being on an exterior surface of said main body, said mounts being adjacent said receptacle.

2. The connection box of claim 1 wherein said first plane is substantially parallel to said second plane.

3. The connection box of claim 1 comprising at least one support wall extending between opposing inner surfaces of said main body.

4. The connection box of claim 1 wherein said receptacle is located on an exterior surface of said main body, and said cramping terminals project into said receptacle through terminal holes in said main body.

5. The connection box of claim 4 wherein there is a plurality of said receptacles located on opposite exterior surfaces of said main body.

6. The connection box of claim 1 wherein each of said mounts comprises a pair of planar plates, substantially parallel to each other and spaced apart by a distance.

7. The connection box of claim 6 wherein said distance is not more than a thickness of said cramping terminal.

8. The connection box of claim 1 comprising an insulating plate within said main body between adjacent said wire planes.

9. The connection box of claim 8 wherein at least some of said cramping terminals project through holes in said insulating plate.

10. An electrical connection box comprising a main body provided with at least one connector receptacle, a first wire group on a first plane within said body, a second wire group on a second wire plane within said body, a first terminal group comprising a plurality of cramping terminals, said cramping terminals being mounted on terminal mounts on an interior surface of said main body, extending both above and below said surface, and being electrically connected to corresponding wires of said first wire group and said second wire group, said cramping terminals projecting into a corresponding connector receptacle, there being two said receptacles, a first said receptacle on a first exterior surface of said main body, and a second said receptacle on a second exterior surface of said main body, said first surface being opposite said second surface, said first terminal group including first cramping terminals electrically connected to corresponding wires of said first wire group and projecting into said first receptacle, a second terminal group includes second cramping terminals electrically connected to corresponding wires of said first wire group and projecting into said second connector receptacle, each of said cramping terminals comprising a projecting portion adapted to project into said first connector receptacle or said second connector receptacle, some said projecting portions being of a first length and other said projecting portions being of a second length, said first length being longer than said second length.

11. The connection box of claim 10 wherein wires on each of said first plane and said second plane contact cramping terminals with projecting portions having said first length and also contact cramping terminals with projecting portions having said second length.

12. An electrical connection box comprising a main body provided with a connector receptacle, a first wire group on a first plane within said body, a second wire group on a second wire plane within said body, a first terminal group comprising a plurality of cramping terminals, said cramping terminals being mounted on terminal mounts on an interior surface of said main body, extending both above and below said surface, and being electrically connected to corresponding wires of said first wire group and said second wire group, said cramping terminals projecting into said connector receptacle, said first plane and said second plane being spaced in a vertical direction normal to at least one said plane, a number of further wire groups within said main body, there being said number of further terminal groups including further cramping terminals which are electrically connected to corresponding wires of said further wire groups, each of said further wire groups being at a further wire plane spaced apart in said vertical direction from all other said planes.

* * * * *